US005735142A

United States Patent [19]

Grenier

[11] Patent Number: 5,735,142

[45] Date of Patent: Apr. 7, 1998

[54] PROCESS AND INSTALLATION FOR PRODUCING HIGH PRESSURE OXYGEN

[75] Inventor: Maurice Grenier, Paris, France

[73] Assignee: L'Air Liquide, Societe Anonyme pour l'Etude et l'Exploitation des Procedes Georges Claude, Paris Cedex, France

[21] Appl. No.: 788,640

[22] Filed: Jan. 27, 1997

[30] Foreign Application Priority Data

Feb. 12, 1996 [FR] France ..... 96 01698

[51] Int. Cl.[6] ..... E25J 3/00

[52] U.S. Cl. ..... 62/646; 62/940

[58] Field of Search ..... 62/646, 940

[56] References Cited

U.S. PATENT DOCUMENTS 5,157,926 10/1992 Guilleminot ..... 62/940
5,329,776 7/1994 Grevier ..... 62/940
5,337,570 8/1994 Posser .
5,475,980 12/1995 Grevier et al. ..... 62/940

FOREIGN PATENT DOCUMENTS 0 672 878 9/1995 European Pat. Off. .
0 689 019 12/1995 European Pat. Off. .

*Primary Examiner*—Ronald C. Capossela
*Attorney, Agent, or Firm*—Young & Thompson

[57] ABSTRACT

A process and a plant in which gaseous oxygen is produced directly at the desired high pressure by pumping liquid oxygen drawn off in the vessel of the low-pressure column (11). The air to be distilled is split into three flows: a flow at the medium pressure of the double distillation column (1), a flow at a high pressure, higher than approximately 60 bars, and a flow at an intermediate pressure which, after partial cooling, is expanded to the medium pressure in a turbine (8). The intermediate pressure is chosen so that the air treated in the turbine is near its dew point at the entry of the turbine wheel. Liquid product is simultaneously drawn off (at 24) from the plant.

13 Claims, 3 Drawing Sheets

PROCESS AND INSTALLATION FOR PRODUCING HIGH PRESSURE OXYGEN

The present invention relates to a process for the production of a gas at a high pressure of at least approximately 30 bars, of the type in which: air is distilled in a double-column plant including a distillation column which operates at a low pressure and a column which operates at a medium pressure, a liquid drawn off from a column of the plant is pumped, the compressed liquid is vaporized, by heat exchange, in a heat exchanger of the type with soldered plates, with the air in the course of cooling and/or liquefaction, and at least one liquid product is drawn from the plant.

The invention applies in particular to the production of large quantities, typically of the order, of at least 500 tons daily, of gaseous oxygen at high pressure.

The pressures referred to are absolute pressures.

Numerous processes of the abovementioned type, known as "pump processes", have been proposed and the aim of the invention is to provide a process of the same type, which is particularly advantageous from the viewpoint of specific energy expenditure.

To this end the subject-matter of the invention is a process of the abovementioned type, characterized in that the air to be distilled is divided into three flows:

- a first airflow at the medium pressure, which is cooled to near its dew point and then introduced into the medium-pressure column;
- a second airflow at a high pressure, higher than approximately 60 bars, this second airflow being cooled and liquefied and then, after expansion, introduced into the double column; and
- a third airflow at an intermediate pressure, at least a portion of this third airflow being, at an intermediate cooling temperature, expanded to the medium pressure in a turbine before being introduced into the medium-pressure column, the intermediate pressure being chosen so that the air is near its dew point at the entry of the turbine wheel.

This process may comprise one or more of the following characteristics:

- the said liquid product is, at least partially, liquid argon produced from an additional column for oxygen/argon separation, coupled to the double column;
- all of the said liquid product consists of liquid argon;
- the compression of the said second airflow from the intermediate pressure to the high pressure is ensured solely by means of the mechanical energy supplied by the turbine;
- the said intermediate temperature is close to the vaporization temperature of oxygen at the high oxygen pressure;
- the oxygen high pressure is close to 40 bars and the flow rate of liquid product drawn from the plant is substantially defined by:

$$D_L = -0.22\,P + 22,$$

where $D_L$ is, in %, the ratio of the flow rate of liquid product drawn off to the total flow rate of oxygen produced, and where P is the air high pressure in bars absolute;

- the flow rate of liquid product drawn off is approximately between 2 and 12% of the total flow rate of oxygen produced;
- the said second and third airflows represent, respectively, approximately 20 to 25% and approximately 10 to 30% of the total flow rate of air to be distilled.

Another subject-matter of the invention is a plant intended for making use of a process as defined above. This plant for the production of gaseous oxygen at a high pressure of oxygen of at least approximately 30 bars, of the type including: a double air distillation column including a column operating at a low pressure and a column operating at a medium pressure, a pump for compressing liquid drawn off from a column of the plant, means for compressing the entering air, a heat exchanger of the type with soldered plates for bringing the air to be distilled and the compressed liquid into a heat exchange relationship, and a conduit for drawing off at least one liquid product from the plant, is characterized in that the means for compression include means for creating three airflows, at the medium pressure, at an intermediate pressure and at a high pressure of air respectively, in that the heat exchanger comprises passages for cooling the medium-pressure air from its hot end to its cold end, passages for partial cooling of the air at the intermediate pressure and passages for cooling the high-pressure air from its hot end to its cold end, and in that the plant includes a turbine for expanding to the medium pressure at least a portion of the partially cooled air at the intermediate pressure, and a column for liquid argon production, coupled to the double column.

In an embodiment of this plant the plant includes an additional heat exchanger for supercooling the liquid drawn off inn the tank of the medium-pressure column by vaporization of liquid oxygen drawn off in the tank of the low-pressure column.

Examples of use of the invention will now be described with reference to appended drawings, in which.

Figure 1:
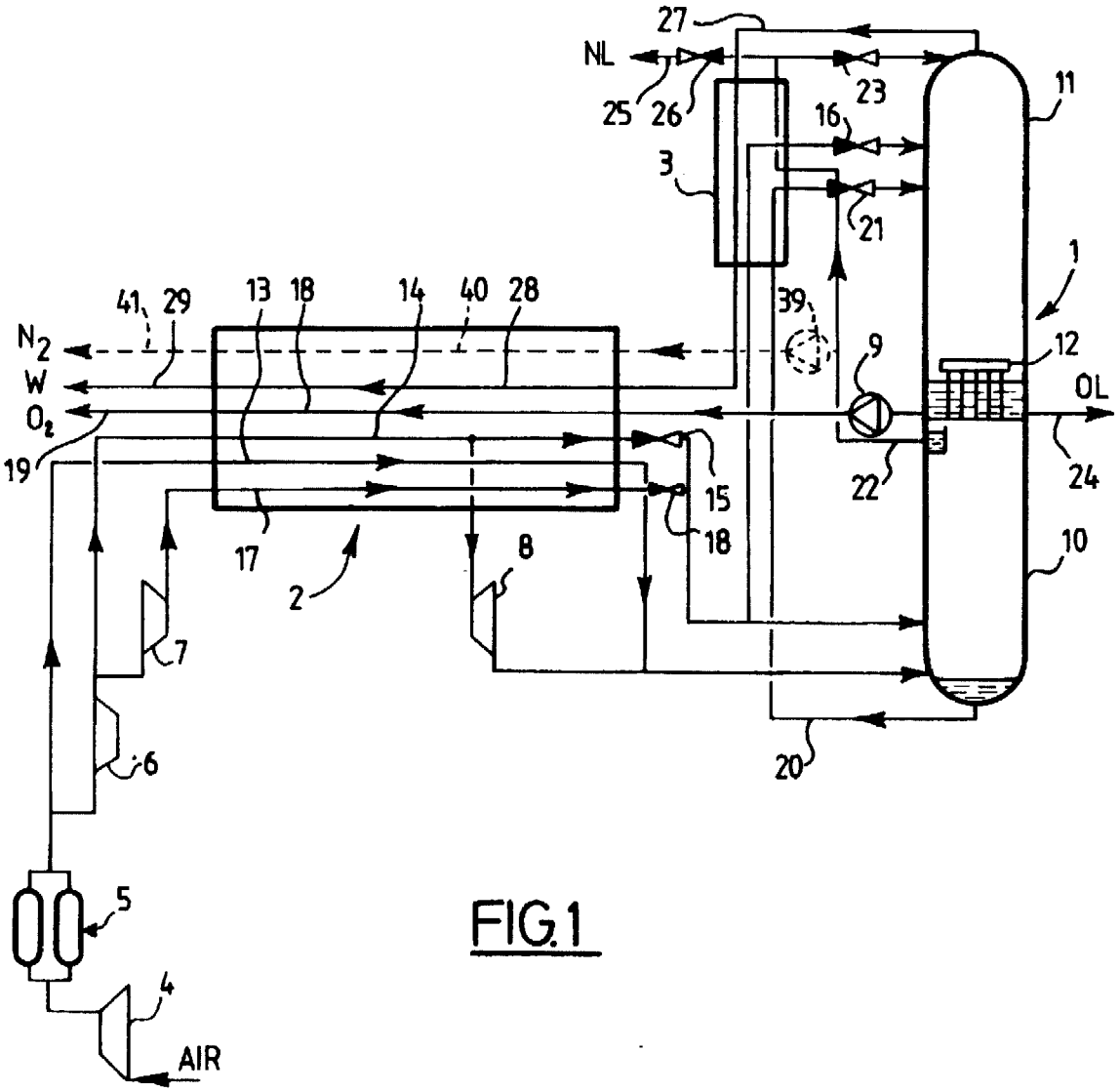
FIG. 1 shows diagrammatically a plant for the production of gaseous oxygen in accordance with the invention.

The plant shown in FIG. 1 is intended to produce gaseous oxygen at a pressure of at least approximately 30 bars. It includes essentially a double distillation column 1, a main heat exchange line 2 consisting of at least one exchanger body of the type with soldered plates, a supercooler 3, an air compressor 4, an apparatus 5 for adsorption purification of the air in respect of water and of $CO_2$, a first air booster 6, a second air booster 7, an expansion turbine 8 and a liquid oxygen pump 9. The double column consists, in a conventional manner, of a medium-pressure column 10 operating at approximately 5 to 6 bars and carrying above it a low-pressure column 11 operating slightly above atmospheric pressure with, in the vessel of the latter, a vaporizer-condenser 12 which brings the liquid oxygen from the vessel of the low-pressure column into a heat exchange relationship with the nitrogen from the head of the medium-pressure column.

In operation, the air to be distilled, totally compressed by the compressor 4 to the medium pressure and purified in 5, is split into two streams.

The first stream is cooled at this medium pressure in passages 13 of the exchange line 2, which extend from the hot end to the cold end of the latter. This medium-pressure air leaves the exchange line in the vicinity of its dew point and is introduced into the base of the medium-pressure column 10.

The remainder of the air which leaves the apparatus 5 is boosted in 6 to an intermediate pressure and is, in turn, split into two flows.

The first flow, at this intermediate pressure, is cooled in passages 14 of the exchange line 2 to an intermediate temperature T1. A portion of this flow optionally continues its cooling, and is liquefied, as far as the cold end of the exchange line, and is then expanded to the medium pressure in an expansion valve 15 and is divided into two streams: a first stream conveyed to the base of the column 10 and a second stream supercooled at supercooler 3, expanded to the low pressure in an expansion valve 16 and conveyed into the column 11. The remainder of the first flow is taken out from the exchange line at the intermediate temperature T1, expanded in the expansion turbine 8 to the medium pressure and introduced into the base of the column 10.

The second boosted airflow is boosted again to a second high pressure of the order of 60 to 80 bars, by the booster 7, and is then cooled and liquefied in passages 17 of the exchange line 2, as far as the cold end of the latter. The liquid thus obtained is expanded in an expansion valve 18 and combined with the liquefied stream originating from the expansion valve 15.

The liquid oxygen drawn from the tank of the column 11 is brought by the pump 9 to the desired output high pressure and is then vaporized and heated in passages 18 of the exchange line before being charged from the plant via an output conduit 19.

The plant in FIG. 1 furthermore also shows the usual conduits and accessories of the double-column plants: a conduit 20 for bringing back up into the column 11 the "rich liquid" (oxygen-enriched air) collected in the vessel of the column 10, with its expansion valve 21, a conduit 22 for bringing back up to the head of the column 11 the "lean liquid" (virtually pure nitrogen) drawn off at the head of the column 10, with its expansion valve 23, and the following conduits: a liquid oxygen output conduit 24, fitted to the vessel of the column 11, a liquid nitrogen output conduit 25, fitted in the conduit 22 and provided with an expansion valve 26, and a conduit 27 for drawing off impure nitrogen constituting the residual gas from the plant, fitted at the head of the column 11. This impure nitrogen is reheated in the supercooler 3 and then in passages 28 of the exchange line before being discharged via a conduit 29. In the supercooler 3 the liquid air originating from the valves 15 and 18, the lean liquid and the rich liquid are supercooled, by approximately 2° C. in the case of the rich liquid.

Figure 2:
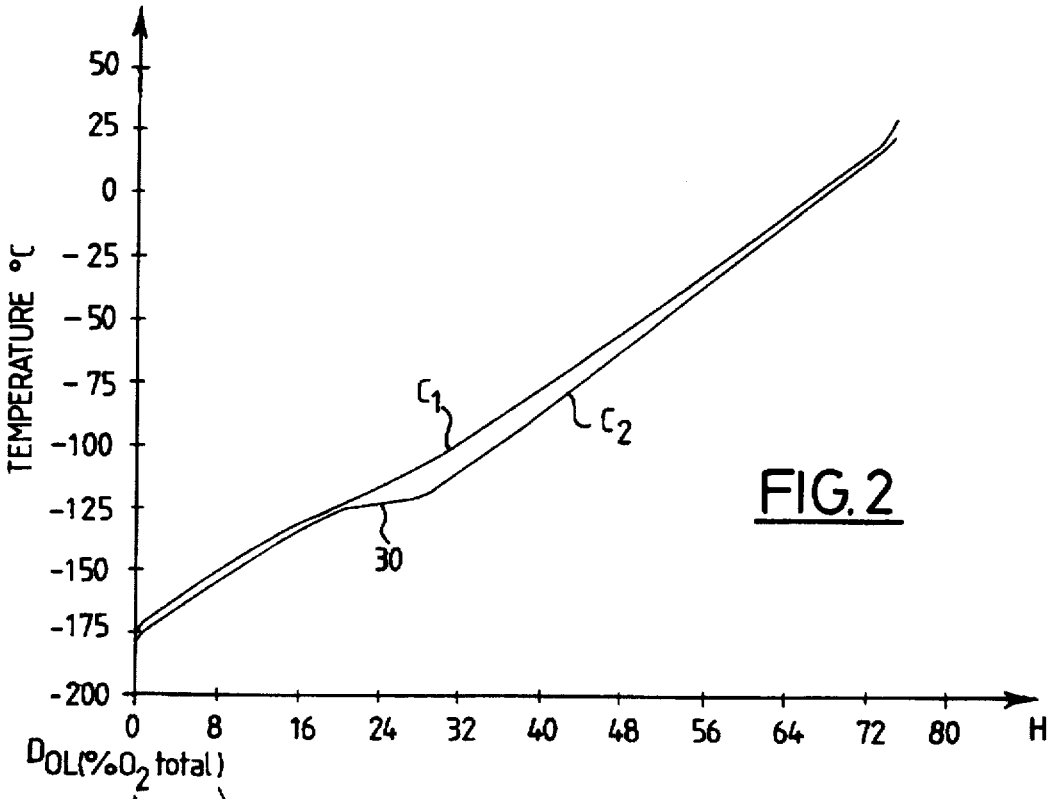
FIG. 2 is a corresponding heat exchange diagram.

To obtain a specific energy expenditure (the specific energy is the energy needed to produce a unit quantity of gaseous oxygen at the high pressure) which is as low as possible, the heat exchange diagram of the exchange line 2 must be as narrow as possible, this being in order to come close to reversible heat exchange conditions. In particular, in the diagram of FIG. 2, where the enthalpies H are plotted as abscissae and the temperatures as ordinates, the temperature differences between the air being cooled (curve C1) and the products being heated (curve C2) must be as small as possible at the hot end and at the cold end of the exchange line, as well as at the beginning of the oxygen vaporization plateau 30.

It has been possible to obtain a mean temperature difference close to 5° C. with a minimum temperature difference of 1.5° C. at the beginning of the plateau 30, from simulation calculations, in the following conditions:

The air high pressure is chosen to be as high as possible, bearing in mind the technology of implementation of the soldered-plate exchanger 2. This high pressure is typically approximately between 60 and 80 bars.

The intermediate temperature T1, which is the entry temperature of the turbine 8, is close to the oxygen vaporization temperature and preferably 1° C. higher than this vaporization temperature.

The intermediate pressure is chosen so that the air treated by the turbine is in the vicinity of its dew point at the entry of the turbine wheel.

As is well known, cryogenic turbines have an entry distributor followed by a wheel. The distributor produces a first release or drop in enthalpy, which is a characteristic of the turbine. The third condition above therefore makes it easily possible to determine the intermediate pressure, which is the pressure at which the air must enter the turbine in order to be in the vicinity of its dew point at the entry of the wheel. This intermediate pressure is approximately between 30 and 40 bars.

Figure 3:
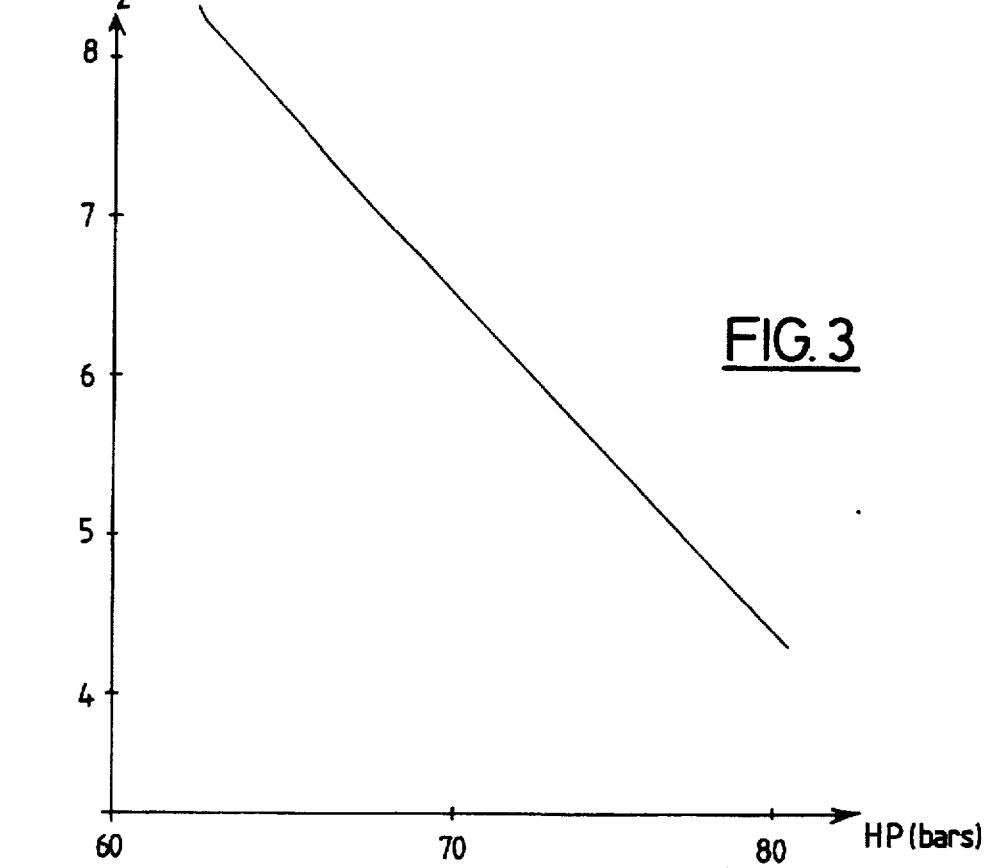
FIG. 3 is a diagram which shows the variation in the plant output of liquid oxygen as a function of the oxygen high pressure, at the economic optimum.

In addition, a certain flow rate of liquid must be drawn off at 24. This liquid correspondingly reduces the quantity of products to be heated in the heat exchange line, and its flow rate is a function both of the oxygen high pressure and of the air high pressure. FIG. 3, established for an oxygen high pressure of 40 bars, shows that the flow rate of liquid producing the economical optimum decreases substantially linearly when the air high pressure P varies from a value slightly higher than 60 bars to 80 bars, according to a law of the type:

$$D_L = -0.22\,P + 22,$$

$D_L$ being, in %, the ratio of the flow rate of liquid oxygen drawn off to the total flow rate of oxygen produced.

As can be seen, this flow rate $D_L$ could be cancelled out if it were possible to choose an air high pressure markedly higher than 80 bars and, according to the calculation, of the order of 100 bars.

In the example described above, the mechanical energy produced by the turbine 8 is recovered in order to contribute to the driving of the booster 7, but the latter also has an external source of driving energy. If, in an alternative form, it is desired to couple the turbine 8 and this booster, in order to simplify the plant, then both the intermediate pressure and the temperature T1 must be raised, and calculation shows that this results in an increase in the flow rate $D_L$ and in the specific energy.

By way of example, the airflows at the intermediate pressure and at the high pressure can represent approximately 20% and approximately 25% respectively, of the flow rate of air which is treated.

Returning to FIG. 3, it is found that, when oxygen is produced at 40 bars, the flow rate $D_L$ is of the order of 4.5% when the air high pressure is close to 80 bars. Now, this percentage is the ratio of argon to oxygen in atmospheric air. Consequently, by appending to the double column an additional column 31 for argon/oxygen separation, followed by means 31A for removing the last traces of oxygen, and then means 31B of denitrogenation, as shown in FIG. 4, the draw-off of liquid product needed to attain the economical optimum can consist solely of the output of pure liquid argon from the plant.

This introduces a particular advantage since, because of the relative complexity of the plant, the process described above is primarily adapted to be employed in large-capacity plants, in which the specific energy is the most important parameter, and these plants are precisely those which justify the addition of an argon production column.

Figure 4:
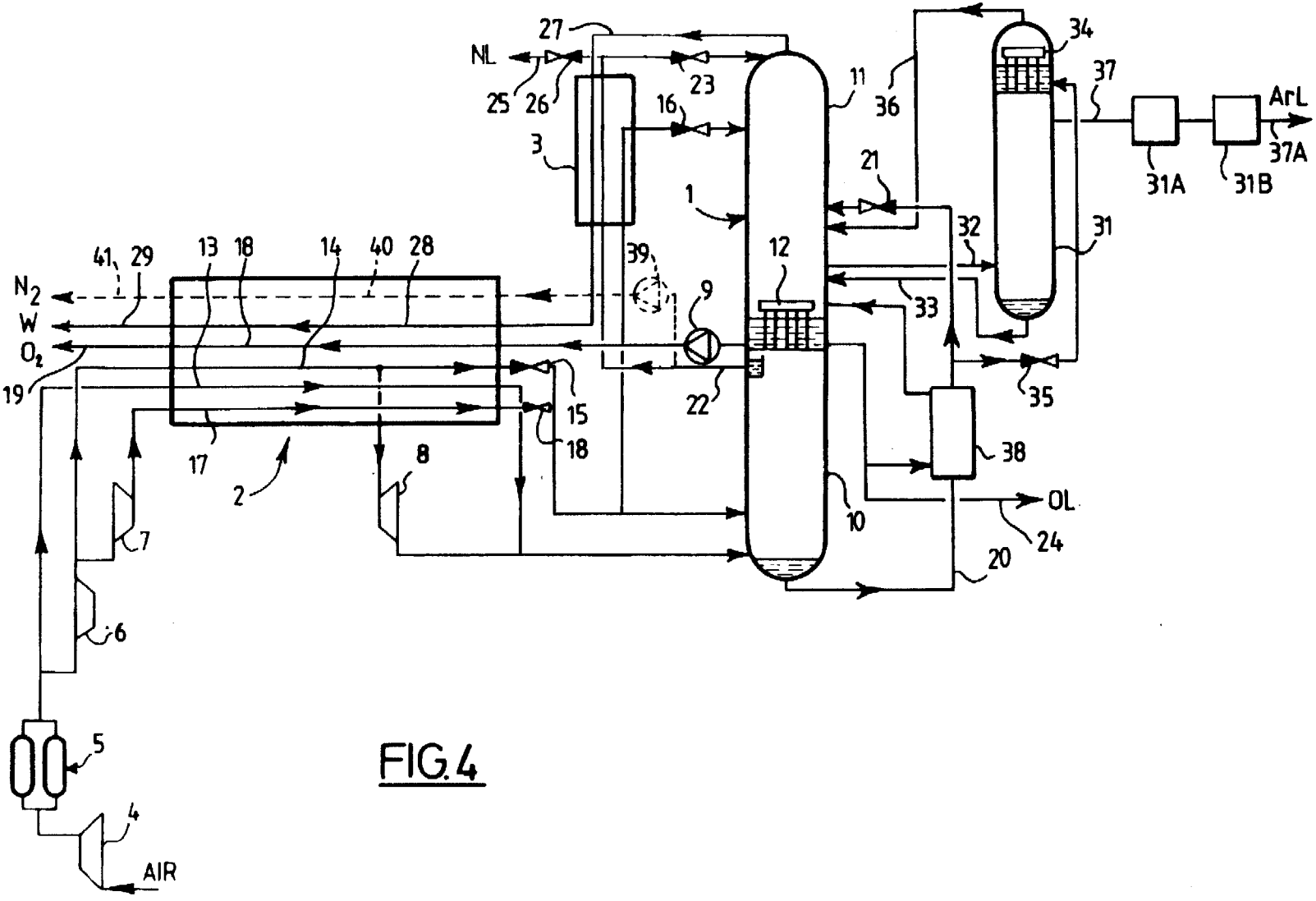
FIG. 4 shows diagrammatically an alternative form of the plant of FIG. 1.

In a conventional manner, in the diagram of FIG. 4, the vessel of the column 31 is connected to the "argon branch connection" of the column 11 via two conduits 32 (feed) and 33 (return), while its head is equipped with a condenser 34 in which rich liquid, expanded at 35 to near atmospheric pressure, is vaporized and then returned into the column 11 via a conduit 36. The impure gaseous argon drawn off at the head of column 31 via a conduit 37 is purified in 31A and then 31B, and the pure argon is drawn off from the plant in liquid form via an output conduit 37A.

In an alternative form, as shown in FIG. 4, the supercooling of the rich liquid before its expansion at 21 and optionally at 35 can be carried out in an additional heat exchanger 38 vaporizing the liquid oxygen drawn off in the tank of column 11. This makes it possible to supercool by 4° to 5° C. the large quantities of rich liquid which circulate in the course of the use of a "pump" process and, consequently, to improve the extraction efficiency of oxygen and, where appropriate, of argon.

Also in an alternative form, as shown by the broken line line in FIGS. 1 and 4, the plant can additionally produce gaseous nitrogen under pressure, this nitrogen being taken in the liquid state from the conduit 22, pumped to the desired pressure by a pump 39, vaporized and then heated in passages 40 of the exchange line 2, and drawn off via an output conduit 41.

It is understood that, in the process of the invention, all or part of the liquid drawn off may also consist of liquid nitrogen (conduit 25).

The liquid vaporized after pumping may be oxygen, nitrogen or argon.

I claim:

1. A process for producing a gas with a double distillation column having a low pressure column and a medium pressure column and a heat exchanger, comprising the steps of:

dividing air that is to be distilled into three airflows before directing the air to the heat exchanger, a first airflow at the medium pressure, a second airflow at a high pressure higher than approximately 60 bars, and a third airflow at an intermediate pressure;

cooling the first airflow to near its dew point in the heat exchanger and then introducing the first airflow into the medium pressure column;

cooling and liquefying the second airflow in the heat exchanger and then expanding the second airflow and introducing it into the double column; and cooling at least a part of the third airflow to an intermediate cooling temperature in the heat exchanger and then expanding the part of the third airflow to the medium pressure in an expansion turbine and introducing it into the medium pressure column, the intermediate cooling temperature being chosen so that the third airflow is near its dew point at its entry into the expansion turbine.

2. The process of claim 1, further comprising the step of drawing off a liquid product that is at least partially liquid argon in a further oxygen/argon separation column that is coupled to the double distillation column.

3. The process in accordance with claim 2, wherein all of said liquid product is liquid argon.

4. The process in accordance with claim 2, wherein the high pressure is close to 40 bars and wherein the flow rate of the liquid product drawn from the plant is substantially defined by:

$$D_L = -0.22\ P + 22,$$

where $D_L$ is, in %, the ratio of the flow rate of liquid product drawn off to the total flow rate of oxygen produced, and where P is the air high pressure in bars absolute.

5. The process in accordance with claim 2, wherein the flow rate of liquid product drawn off is approximately between 2 and 12% of the total flow rate of oxygen produced.

6. The process in accordance with claim 1, further comprising the step of compressing said second airflow from the intermediate pressure to the high pressure solely by means of the mechanical energy supplied by the turbine.

7. The process in accordance with claim 1, wherein said intermediate cooling temperature is close to the vaporization temperature of the liquid at the high pressure.

8. The process in accordance with claim 1, wherein said second and third airflows represent, respectively, approximately 20 to 25% and approximately 10 to 30% of the total flow rate of air to be distilled.

9. The process according to claim 1, further comprising the step of providing a vaporized liquid that is one of oxygen, nitrogen and argon.

10. Plant for the production of a gas at a high pressure of at least approximately 30 bars, comprising:

a double air distillation column (1), with a column operating at a low pressure (11) and a column operating at a medium pressure (10), a pump (9) for compressing liquid drawn from said low pressure column, a heat exchanger (2) with soldered plates for bringing the air to be distilled and the compressed liquid into a heat exchange relationship, a conduit (24, 25, 37A) for drawing off at least one liquid product from the plant, means for compression including means (4, 6, 7) for creating three airflows, at the medium pressure, at an intermediate pressure and at a high pressure of air, respectively, wherein said heat exchanger (2) comprises passages (13) for cooling the medium-pressure air from its hot end to its cold end, passages (14) for partial cooling of the air at the intermediate pressure and passages (17) for cooling the high-pressure air from its hot end to its cold end, a turbine (8) for expanding to the medium pressure at least a portion of the partially cooled air at the intermediate pressure, and a column (31) for liquid argon production, coupled to the double column (1).

11. The plant according to claim 10, further comprising an additional heat exchanger (38) for supercooling the liquid drawn off in the tank of the medium-pressure column (10) by vaporization of the liquid drawn off from the low pressure column (11).

12. Process for the production of a gas at a high pressure, comprising the stems of distilling air in a plant with a double distillation column (1) including a column (11) which operates at a low pressure and a column (10) which operates at a medium pressure, expanding a portion of the air to the medium pressure in a turbine (8) before being introduced into the medium-pressure column, the air pressure being chosen so that the air is near its dew point at the entry of the turbine.

13. The process according to claim 12, in which the air to be expanded in the turbine is cooled before its expansion using gas originating from the double column.

* * * * *